US008123004B2

(12) United States Patent
Klasing et al.

(10) Patent No.: US 8,123,004 B2
(45) Date of Patent: Feb. 28, 2012

(54) RAIL HANDBRAKE WITH PROLONGED RELEASE

(75) Inventors: Wayne G. Klasing, New Lenox, IL (US); Paul Borgarding, Marseilles, IL (US); Steven R. Newton, Adams, NY (US); Jeffrey F. Sauter, Lowville, NY (US)

(73) Assignee: New York Air Brake Corporation, Watertown, NY (US)

( * ) Notice: Subject to any disclaimer, the term of this patent is extended or adjusted under 35 U.S.C. 154(b) by 505 days.

(21) Appl. No.: 12/362,542

(22) Filed: Jan. 30, 2009

(65) Prior Publication Data

US 2010/0193755 A1 Aug. 5, 2010

(51) Int. Cl.
*B61H 13/04* (2006.01)

(52) U.S. Cl. ..... 188/34; 188/107; 74/505; 74/529

(58) Field of Classification Search ..... 188/33, 188/34, 107; 74/504, 505, 506, 527, 528, 74/529; 192/12 R, 12 B, 12 BA
See application file for complete search history.

(56) References Cited

U.S. PATENT DOCUMENTS

| | | | | |
|---|---|---|---|---|
| 3,027,985 | A | 4/1962 | Klasing, Jr | |
| 3,173,305 | A * | 3/1965 | Mersereau | 74/505 |
| 3,425,294 | A | 2/1969 | Klasing | |
| 3,988,944 | A | 11/1976 | Klasing | |
| 4,291,793 | A | 9/1981 | Klasing | |
| 4,368,648 | A | 1/1983 | Housman et al. | |
| 5,201,890 | A | 4/1993 | Sauer et al. | |
| 5,558,411 | A | 9/1996 | Kanjo et al. | |
| 6,364,428 | B1 | 4/2002 | Labriola et al. | |
| 6,474,450 | B1 | 11/2002 | Ring et al. | |
| 7,021,430 | B2 | 4/2006 | Ring et al. | |
| 2004/0188195 | A1 | 9/2004 | Ring et al. | |
| 2007/0056814 | A1 | 3/2007 | Michel et al. | |
| 2007/0151812 | A1 | 7/2007 | Michel et al. | |

FOREIGN PATENT DOCUMENTS

EP 1 459 953 A1 9/2004

* cited by examiner

*Primary Examiner* — Thomas J Williams
(74) *Attorney, Agent, or Firm* — Barnes & Thornburg LLP

(57) ABSTRACT

A hand brake actuator for a rail car has a rotary input connected to a rotary output by a transmission including a clutch and a ratchet wheel and pawl, a declutching mechanism for disengaging the clutch in a declutched position of the declutching mechanism, and a release handle with a first cam which drives the declutching mechanism to the declutched position when the release handle is moved from an apply position to a release position. A second cam is biased in a first direction to engage and retain the declutching mechanism in a declutched position after the release handle is removed from the release position. A follower is connected to the second cam and is responsive to the rotation of the input in an apply direction to rotate the second cam in a second direction opposite the first direction to release the declutching mechanism and allow the clutch to reengage.

10 Claims, 7 Drawing Sheets

RAIL HANDBRAKE WITH PROLONGED RELEASE

BACKGROUND OF THE INVENTION

The disclosure relates generally to hand brake mechanisms adapted for use on railway cars and more particularly, to mechanisms of the quick-release type having a prolonged release.

U.S. Pat. Nos. 3,425,294; 3,988,944 and 4,291,793 disclose hand brake mechanisms or actuator of the quick-release type, which are adapted for use on railway cars. The disclosed mechanisms also incorporate structure providing for gradual release of the car brakes. Both gradual and quick releases are effected without spinning of the hand wheel which is manually rotated for application and for gradual release of the brakes. More particularly, two clutches are arranged in series relationship in a power train or transmission from the hand wheel to the car brakes. A self-energizing friction clutch associated with coaxial separate shafts in the power train provides for gradual release of the brakes. A manually-operated clutch of the jaw type provides for quick release of the brakes.

The mechanism of the patents includes a pivoted yoke assembly having shift lever or fork components, and a cam shaft having a handle or lever connected thereto for manual operation. The cam shaft is provided with a cam operating in one direction of rotation of the shaft to pivotally move the yoke assembly so as to separate components of the quick-release clutch for releasing the brakes. A second cam on the cam shaft functions upon rotation of the cam shaft in the opposite direction to cam the yoke assembly in a direction to drivingly engage the clutch components, and to assist a biasing spring in maintaining the engagement of the components.

SUMMARY OF THE INVENTION

The present hand brake actuator for a rail car has a rotary input connected to a rotary output by a transmission including a clutch and a ratchet wheel and pawl, a declutching mechanism for disengaging the clutch in a declutched position of the declutching mechanism, and a release handle with a first cam which drives the declutching mechanism to the declutched position when the release handle is moved from an apply position to a release position. A second cam is biased in a first direction to engage and retain the declutching mechanism in a declutched position after the release handle is removed from the release position. A follower is connected to the second cam and is responsive to the rotation of the input in an apply direction to rotate the second cam in a second direction opposite the first direction to release the declutching mechanism and allow the clutch to reengage.

At least one pin may be mounted on the ratchet wheel and the follower engages and is deflected by the pin when the input is rotated in the apply direction. A plurality of pins may be mounted and spaced circumferentially on the ratchet wheel. Alternatively, the follower may engage and be deflected by the teeth of the ratchet wheel or by the pawl when the input is rotated in the apply direction.

The second cam, the follower and the pawl may be mounted on a common post. A bracket between the pawl and the follower acts a stop for the follower in the first direction of the second cam and the follower. The second cam is shaped to be over center when it engages the declutch mechanism. The second cam has a length shorter than the release position of the declutch mechanism adjacent the second cam and produced by the first cam. The second cam and the follower may be unitary or two elements connected by a lost motion mechanism.

These and other aspects of the present invention will become apparent from the following detailed description of the invention, when considered in conjunction with accompanying drawings.

DETAILED DESCRIPTION OF THE PREFERRED EMBODIMENTS

Figure 1:
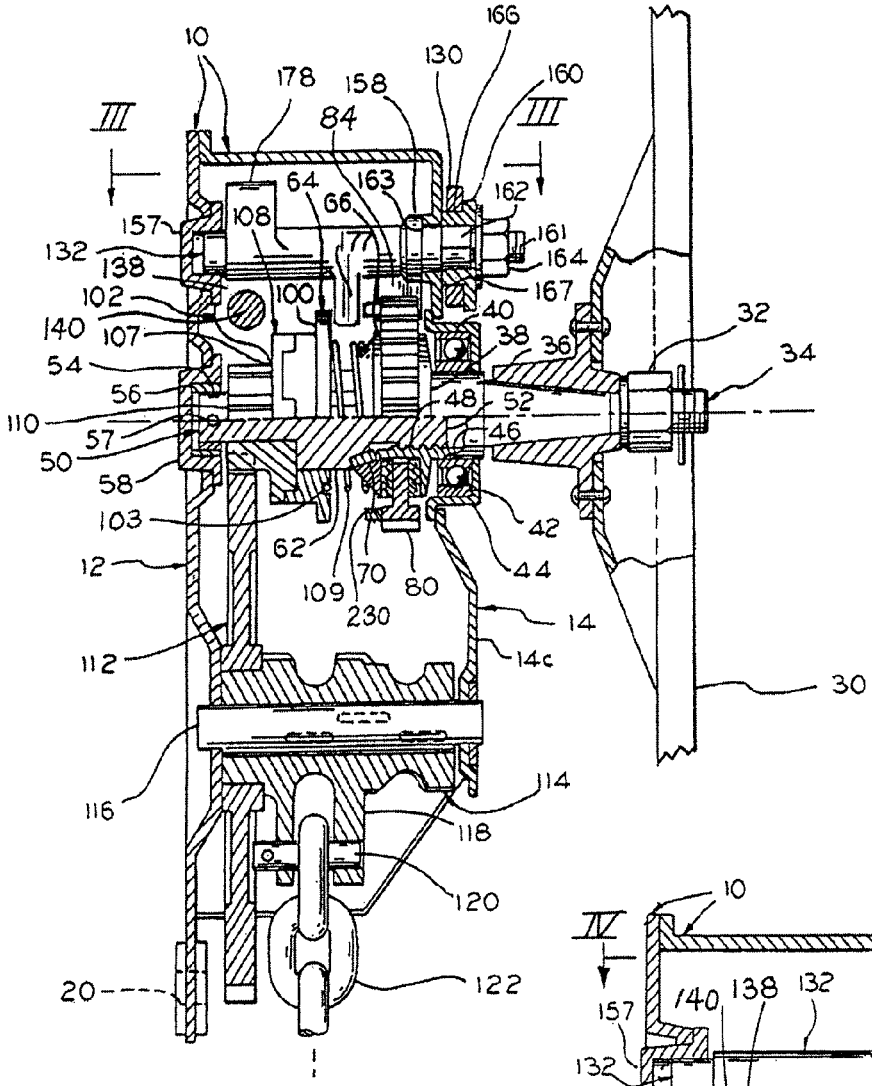
FIG. 1 is a vertical sectional view of a hand brake actuator in a clutch engaged condition for applying the brakes according to the present disclosure, with certain parts shown partly in elevation and partly in section.

Since the illustrative hand brake mechanism represents an improvement on the above-identified U.S. Pat. No. 4,291,793, and it includes various elements which are the same as or similar to the elements of the patent structure, such elements have been identified in the drawings by like reference numerals, for convenience of reference.

Referring to the drawings in detail and in particular to FIGS. 1-5 a hand brake mechanism in accordance with the invention is mounted in a two-piece housing 10, which includes a rear base member 12, and a front cover member 143. These members are adapted to be secured together by rivets 16 or other fastening devices. The base member 12 of the housing 10 is a generally flat plate, while the cover member 14 is of cup shape configuration and embodies an outwardly extending flange 18 through which the rivets 16 extend. Bolt holes 20 are provided in the corner portions of the housing 10, in order that the entire assembly may be bolted to an end wall of a railway car in the usual manner.

A conventional hand wheel 30 is affixed by a nut 32 to the front end of a horizontal rotatable hand wheel or drive shaft 34. The shaft 34 extends through an opening in the cover member 14 and is provided on the rear portion thereof with an enlarged hub 36. A radial circular clutch reaction flange 38 extends from the hub 36 intermediate its ends. The hub 36 is journalled in an antifriction ball bearing assembly 40 which is nested within a recess 42 on the inside of a front wall plate 44 seated in an opening in the cover member 14. The rear end of the hub 36 is formed with a relatively deep central cylindrical socket 46 (see FIG. 5) which has a threaded section 48 near its rim portion.

Figure 5:
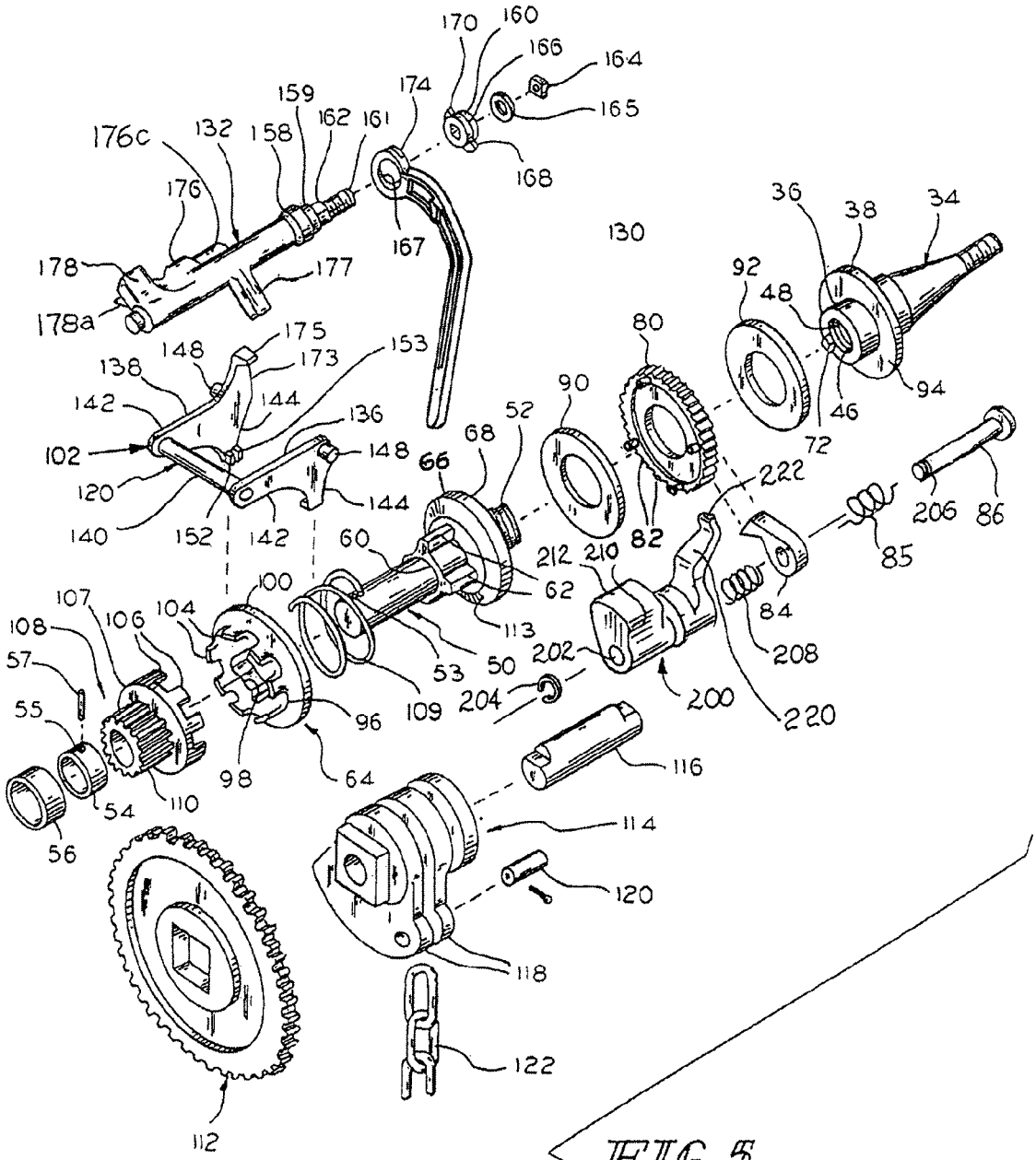
FIG. 5 is an exploded perspective view of the mechanism showing parts of a drive train and cooperating parts therein.

Referring to FIG. 5, a horizontal axially shiftable clutch shaft 50 is disposed within the housing 10 in coaxial relationship to the hand wheel shaft 34 and includes at its front end a reduced threaded pilot stem 52 which is threadedly received in the threaded section 48 of the socket 46. The rear end region of the clutch shaft 50 is cylindrical, and a retainer pin opening 53 extends there through. A cylindrical pinion retainer sleeve 54 having a retainer pin opening 55 there through is mounted on the end region of the shaft 50 by a retainer pin 57, which extends through the registering retainer pin openings 53 and 55.

The retainer sleeve 54 is journalled in a cylindrical bushing 56, where the outer surface of the sleeve serves as a bearing surface for rotatably supporting the clutch shaft 50. The bushing 56 is fixedly mounted in a seat 58 in the upper portion of the base member 12. An enlarged integral medial drive member or slide section 60 is formed on the clutch shaft 50. The drive member 60 includes four radial splines 62, which extend in the axial direction or longitudinally of the shaft 50. The splines 62 cooperate with a jaw-clutch collar 64, as described hereinafter.

Immediately forwardly of the drive member 60 and integrally therewith, a circular radial friction-clutch reaction flange 66 is integrally formed on the clutch shaft 50 and is provided with a forwardly facing clutch face 68. A stop pin 70 is threadedly received in an internally-threaded socket in the latter flange 66, cooperates with an abutment boss 72 on the rim of the hub socket 46, and limits the extent of relative turning movement of the two shafts 34 and 50.

The rear end of the hub 36 of the hand wheel shaft 34 serves to support rotatably thereon a ratchet wheel 80 having teeth 82. A pivoted pawl 84 and biasing spring 85 (see FIGS. 3-5) are mounted on a horizontal cylindrical pin 86. The pin 86 is supported on the cover member 14 and a bracket 83 (see FIGS. 3 and 4).

A friction disk 90 is slidably mounted on the rear end of the hub 36 and interposed between the forwardly facing clutch face 68 of the reaction flange 66 and the rear face of the ratchet wheel 80. A similar friction disk 92 is slidably mounted on the rear end of the hub 36 and interposed between the rearwardly facing clutch face 94 of the reaction flange 38 and the front face of the ratchet wheel 80. The two friction disks 90,92 and the ratchet wheel 80 are capable of limited axial movement on the hub 36.

Figure 2:
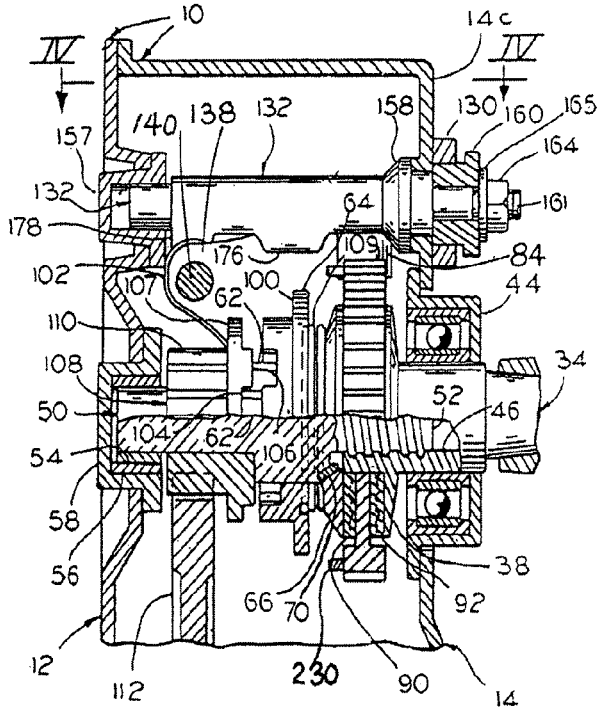
FIG. 2 is a view like FIG. 1, but with the clutch disengaged to release the car brakes.
Figure 3:
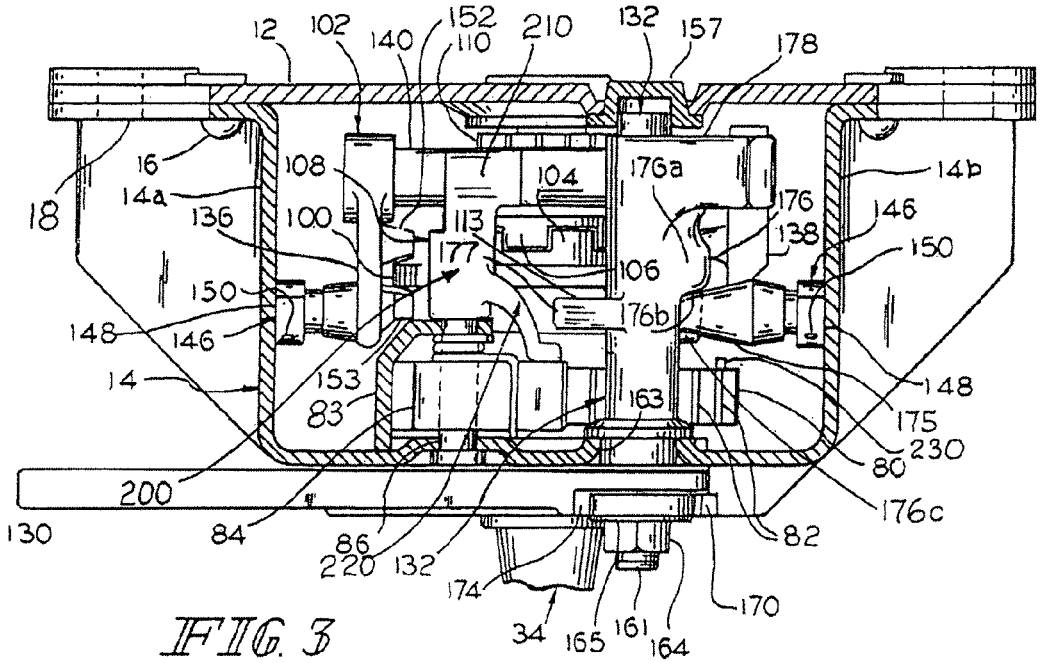
FIG. 3 is a further enlarged horizontal sectional view of the mechanism, taken substantially on line III-III of FIG. 1.
Figure 4:
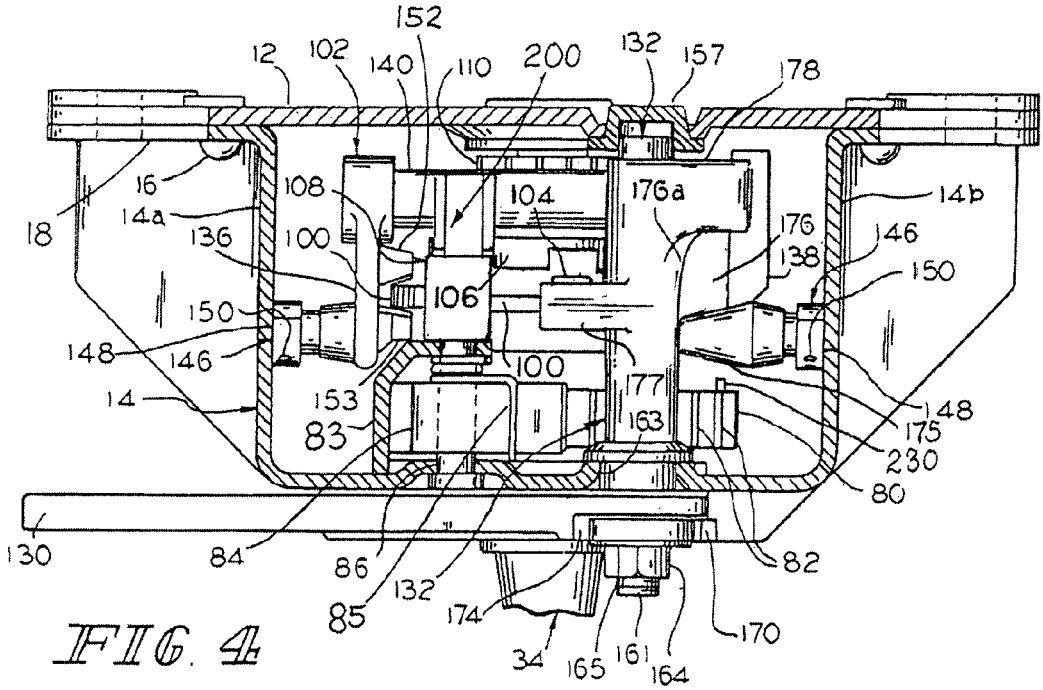
FIG. 4 is a further enlarged horizontal sectional view of the mechanism, taken substantially on line IV-IV of FIG. 2.

Consequently, when the hand wheel 30 is manually rotated-in a clockwise direction as viewed in FIGS. 3 and 4 and from the right hand side of FIGS. 1 and 2, the two friction disks 90, 92 and the interposed ratchet wheel 80 will be compressed as a unit between the clutch faces 68 and 94. The entire friction clutch assembly including the handwheel shaft 34 and the clutch shaft 50 then becomes locked up and consequently rotates as a unit for application of the car brakes.

As best illustrated in FIG. 5, the jaw-clutch collar 64 is capable of limited sliding movement on the drive member 60 on the clutch shaft 50. The clutch collar 64 includes a body 96, which defines a central opening 98 slidably receiving the drive member 60 and providing four keyways for the four splines 62 of the drive member. A radial flange 100 circumscribes the body 96 and provides engagement means by which the collar 64 may be shifted bodily in opposite directions along the axis of the clutch shaft 50, by a pivoted yoke assembly or declutching 102. The clutch collar 64 also is formed with an annular series of spaced apart clutch teeth 104, which project rearwardly from the body 96.

In the foregoing manner, the jaw-clutch collar 64 is mounted on the drive member 60 for releasable clutching engagement with a combined pinion, and clutch wheel 108. The pinion and clutch wheel 108 includes a clutch wheel 107 having an annular series of forwardly projecting spaced-apart clutch teeth 106, and a pinion 110 integral with the clutch wheel. The pinion and clutch wheel 108 is mounted for free rotation on the clutch shaft 50, between the pinion retainer sleeve 54 and the drive member 60, which serve to restrain the wheel 108 from rearward or forward longitudinal sliding movement on the shaft.

The clutch teeth 104 on the clutch collar 64 and the clutch teeth 106 on the clutch wheel 107 are constructed and spaced apart for inter-fitting with or inter-engaging each other, to place the clutch collar 64 and the clutch wheel 107 in clutching engagement. Normally, the clutching engagement is maintained by a helical compression spring 109 which surrounds the clutch shaft 50 and is interposed between the circular reaction flange 66 on such shaft and the body 96 of the clutch collar 64. The rear end of the spring 109 seats within an annular groove 111 (FIG. 1) which is formed in the front face of the clutch collar 64, while the front end of the spring bears against a frustoconical seating surface 113 on the rear face of the reaction flange 66. The spring 109 thus is centered about the clutch shaft 50 in coaxial relationship.

The pinion 110 of the combined pinion and clutch wheel 108 meshes with a main winding spur gear 112 of relatively large diameter. The main winding gear 112 is mounted on and rotatable with a drum member 114 which, in turn, is mounted on a horizontal drum shaft 116 supported at its ends in the lower regions of the base member 12 and the cover member 14 of the housing. The drum member 114 is provided with an integral radially extending bifurcated crank arm 118 which carries at its distal end a horizontal crank pin 120. The latter passes through the uppermost link of a brake chain 122 and is secured in place by a cotter pin 123. The brake chain 122 is connected to the brake shoe mechanism (not shown), for application of the car brakes by tensioning the chain.

From the above description, it will be apparent that when the jaw-clutch collar 64 is maintained in its normally clutched engagement with the combined pinion and clutch wheel 108, the hand brake mechanism functions in the manner of a conventional non-spin brake mechanism. Namely, the application of the car brakes or release of braking tension in the chain 122 is in small increments and without the application of spinning torque to the hand wheel 30. When fully released, the brake chain 122 is unwound from the drum member 114 and, therefore, is slack. The friction clutch assembly, including the ratchet wheel 80 and the friction clutch disks 90 and 92, may be disengaged, and the clutch shaft 50 backed off, so to speak, on the internally-threaded section 48 of the socket 46.

When it is desired to apply the car brakes, the handwheel 30 is rotated manually in a clockwise direction as viewed in FIGS. 3 and 4 and from the right hand side of FIGS. 1 and 2. As the hand wheel 30 and the hand wheel shaft 34 are turned in such clockwise direction, the clutch shaft 50, being in threaded engagement with the hand wheel shaft, is caused to move forwardly. This results from the rotational movement of the pinion 110 being restricted by the inertia of the spur gear 112, the drum member 114 and the brake chain 122, as well as by the gravitational and tensional drag on the chain by members connecting the same to the car brakes. Ultimately, the reaction flange 66 on the clutch shaft 50 and the opposing reaction flange 38 on the hand wheel shaft 34 function to lock up the entire friction clutch mechanism. The clutch shaft 50 then rotates in unison with the hand wheel 30 and the hand wheel shaft 34, and establishes a rigid power train or transmission leading to the brake chain 122. The drum member 114 rotates upon continued rotation of the hand wheel 30, causing the crank pin 120 to move upwardly and the chain 122 to commence winding upon the drum member, thus gradually applying the car brakes.

At such time as the car brakes become set, the countertorque on the pinion 110 has a tendency to impart reverse rotation to the pinion. Such a tendency is effective to thread the forward end of the clutch shaft 50 into the socket 46 in the hand wheel shaft 34 and maintain the friction clutch assembly locked up. Consequently, the pawl 84 will be effective against the entire clutch assembly and not merely against the ratchet wheel 80, and the brakes will not be released even though the hand wheel 30 be released by the operator.

In order to gradually release of the car brakes, the hand wheel 30 is turned in a counterclockwise direction as viewed in FIGS. 3 and 4, as viewed from the right-hand side of FIGS. 1 and 2, through any desired small increment of rotation. The counterclockwise rotation of the hand wheel 30 causes the mating threads on the shafts 34 and 50 to be turned relative to each other. This backs off the clutch shaft 50 and thereby relieving the pressure of the friction disks 90 and 92, to disengage the friction clutch assembly. The clutch shaft 50 is permitted to rotate, and the pinion 110 rotates therewith, to partially release the tension in the brake chain 122. Such partial release will take place only during such time as counterclockwise turning force or torque is applied to the hand wheel 30. Immediately upon cessation of such turning force, the countertorque which is applied through the power train and leading from the brake chain 122 to the clutch shaft 50 will automatically re-engage the friction clutch parts, to prevent further relative rotation of the parts and release of chain tension.

In order to effect quick release of the car brakes, the jaw-clutch collar 64 is shifted from its drive position, illustrated in FIGS. 1 and 3, to its brake-release position, illustrated in FIGS. 2 and 4. In the drive position, the collar 64 engages the splines 62, and the clutch teeth 104 on the collar intermesh with the clutch teeth 106 on the clutch wheel 107, to drivingly interconnect the drive member 60 and the pinion 110 for application of the car brakes. In the brake-release position, the clutch teeth 104 and 106 are separated, thereby breaking the connection between the drive member 60 and the pinion 110, so that the pinion is freely rotatable on the clutch shaft 50. Under the latter conditions, any tension in the brake chain 122 is released, thereby releasing the car brakes.

The control mechanism for shifting the clutch collar 64 between its position of clutched engagement with the clutch wheel 107 and its position of disengagement includes a quick-release handle or lever 130. The lever 130 operates through a horizontal cam shaft 132 to control the rocking movements of the pivoted yoke assembly 102. The latter, in turn, operates as a dual shift lever or fork to engage the radial flange 100 of the clutch collar 64 and shift the same bodily into and out of clutching engagement with the combined pinion and clutch wheel 108.

Referring especially to FIGS. 3-5, the yoke assembly or declutching mechanism 102 is comprised of two shift levers or forks 136 and 138 which are rigidly connected together by a connecting rod 140. Each lever, in effect, is a bell crank lever having a generally horizontally extending rocker arm 142 and a depending collar-engagement arm 144. The levers are pivoted to the opposite side walls 14*a* and 14*b* of the cover member 14 of the housing 10, near the junctures between the arms 142 and 144. The pivotal mounting is provided by cradle supports 146 on the side walls 14*a*, 14*b*, and trunnions 148 on the levers 136,138. Each support 146 includes a bearing 147, a key 149 which interfits with the bearing 147, and a cotter pin 150 which extends through registering holes in the bearing and key, to secure them together. Each trunnion 48 is journalled in the bearing 147 of one of the supports 146. The connecting rod 140 extends between and has its ends fixed to the outer ends of the rocker arms 142.

The lower end of each collar-engagement arm 144 carries two collar-engaging members in the form of spaced, opposed lugs 152 and 153. The lugs project inwardly and straddle the peripheral flange 100 of the jaw-clutch collar 64, for imparting longitudinal shifting motion to the clutch collar 64 when the pivoted yoke assembly 102 is swung about the axis of its trunnions 148.

An integral upstanding lug arm 173 forms a part of one lever 138 at the junction of its remaining arms 142 and 144. A locking lug 175 is integral with the outer end of the lug arm 173 and projects laterally inwardly there from. The locking lug 175 and the collar-engaging lugs 152,153 are disposed on opposite sides of the transverse axis through the trunnions 148, about which the yoke assembly 102 and the levers 136, 138 thereof pivot. Consequently, the respective lugs 152,153 and 175 move in opposite directions between the rear base member 12 and the front cover member when the yoke assembly 102 is rocked about such axis.

The cam shaft 132 is disposed in the upper portion of the housing 10, above the level of the trunnions 148 and in parallel relation to the hand wheel 30 and clutch shafts 34 and 50. The ends of the cam shaft 132 are journalled for rotation on the base and cover members 12 and 14 of the housing. The rear end of the cam shaft 132 is mounted in the seat 157 in the base section 12, while the front end of the cam shaft 132 projects through the front wall 14*c* of the cover member 14.

The cam shaft 132 has an integral radial flange 158, a cylindrical journal 159, a squared portion 162, and a threaded portion 161 adjacent to its front end. The cam shaft is mounted in the front wall 14*c* with its flange 158 engaging the inside of the wall, and its journal 159 rotating in a circular bearing portion 163 in the wall. An abutment sleeve 160 is mounted on the squared portion 162 and adjacent to the outside of the front wall 14*c*. The sleeve 160 is secured by a nut 164 and washer 165 on the threaded portion 161.

A circular opening 167 is provided in the proximal end of the handle 130, which opening receives a cylindrical portion 166 of the abutment sleeve 160, to mount the handle thereon. A pair of angularly spaced stop lugs 168 and 170 on the abutment sleeve 160 and a pair of spaced abutment shoulders 172 and 174 on the inner end of the handle cooperate to provide a lost-motion connection between the sleeve and the handle. This enables the handle to swing in idle fashion and without function between engagement of respective lugs and shoulders. During the idle motion of the handle 130, rocking movement of the cam shaft 132 is not effected. However, when the lower abutment shoulder 172 on the handle 130 engages the stop lug 168 on the abutment sleeve 160, counterclockwise (as seen in FIGS. 3 and 4) or downward movement of the handle will impart counterclockwise rocking motion to the cam shaft 132. When the upper shoulder 174 on the handle 130 engages the stop lug 170 on the sleeve 160, clockwise or upward movement of the handle will impart clockwise rocking motion to the cam shaft 132.

In an, alternative embodiment, not illustrated, the abutment sleeve 160 is omitted, and a quick-release handle having a square opening in its proximal end is mounted directly on the squared portion 162 on the cam shaft. In such embodiment, rotation of the handle in either direction causes the cam shaft 132 to rotate therewith, and there is no lost motion connection.

A first reaction or locking member 176, a second reaction or locking member 177, and a brake-release or hold-down cam 178 are mounted on the cam shaft 132 integrally therewith, in angularly offset relation to each other and disposed rearwardly of the flange 158.

The first reaction member 176 is a lug-like member extending laterally outwardly from the cam shaft 132. The first reaction member 176 includes a cam surface 176*a*, which lies substantially in a plane oblique or inclined with respect to the longitudinal axis of the cam shaft 132. The first reaction member 176 includes a stop surface 176*b* in a plane extending transverse to the cam shaft axis and extending at an obtuse angle or obliquely to the cam surface 176*a*. The first reaction member 176 includes a seating surface 176*c* in a plane parallel to the cam shaft axis and substantially perpendicular to the stop surface 176*b*. A substantially right-angled recess is formed in the reaction member, and it is bounded by the stop surface 176*b*, the seating surface 176*c*, and the cam shaft 132, on respective sides thereof.

The brake-release cam 178 is an elongated block-like member extending laterally outwardly from the cam shaft 132, and its undersurface 178*a* constitutes a cam surface. The brake-release cam 178 is arranged for direct engagement of its cam surface 178*a* with one shift lever 138 of the yoke assembly 102, and the yoke assembly in turn directly engages the jaw-clutch collar 64, by the members 152 and 153. The first reaction member 176 also is arranged for direct engagement with the one shift lever 138.

The second reaction member 177, on the other hand, is arranged for direct engagement with the collar 64. When the brake-release cam 178 is in its said engagement, the first and second reaction members 176 and 177 are disengaged from elements of the yoke assembly or the clutch, and vice versa.

The brake-release cam 178 cooperates with the distal end of the rocker arm 142 of one yoke assembly shift lever 138, i.e., the lever which bears the locking lug 175. The quick-release handle 130 is pulled upwardly from the apply position shown in FIG. 6 to the quick release position shown in FIG. 7, thereby rotating the cam shaft 132 in the counterclockwise direction. The brake cam 178 engages the rocker arm 142 of the lever 138 during such rotation. As a result, both of the rocker arms 142 move downwardly, whereby the shift levers 136 and 138 move pivotally about the axis of the trunnions 148. The engagement arms 144 of the levers 136 and 138 thereby are caused to rock forwardly.

At this time, the rear collar-engaging members 152 on the engagement arms engage the flange 100 of the jaw-clutch collar 64, to shift the collar forwardly, while compressing the clutch spring 109. This action shifts the collar 64 from its drive or engaged position is to its brake-release or disengaged position, thereby to release the car brakes. During the engagement of the brake-release cam 178 with the cam-actuated lever 138, the reaction members 176 and 177 are in out-of-the-way positions; wherein they do not interfere with the movements of 20 the yoke assembly 102 and the collar 64.

The description so far is substantially the same as that in U.S. Pat. No. 4,291,793. The modification to produce a prolonged or sustained release follows and have reference numbers in the 200s The improvement in the hand brake actual for includes providing a prolonged release mechanism which retains the declutching mechanism in a de-clutch position after the release handle 130 is moved from the release position. The mechanism assures a prolonged release even though the operator has removed their hand from the quick release handle 130. This mechanism must be reset in response to the rotation of the input or hand wheel 30 in an applied direction so as to release the de-clutching mechanism 120 and allow the clutch to re-engage.

The prolonged release mechanism 200 is best illustrated in FIG. 5. It includes a bore 202 to be received on the pawl pin 86, which is larger than the previous pawl pin 86. The prolonged release mechanism 200 is retained on the pawl pin 86 by a snap ring 204 received in a groove 206 at the end of the pawl pin 86. A spring 208 biases the prolonged release mechanism 200 in a first direction towards engagement with the clutch mechanism and to retain the clutch mechanism in a de-clutch position.

The bracket 83 for the pawl pin 86 acts as a stop for the leg portion 226 of the follower 220 to limit its rotation in the release direction.

Figure 7:
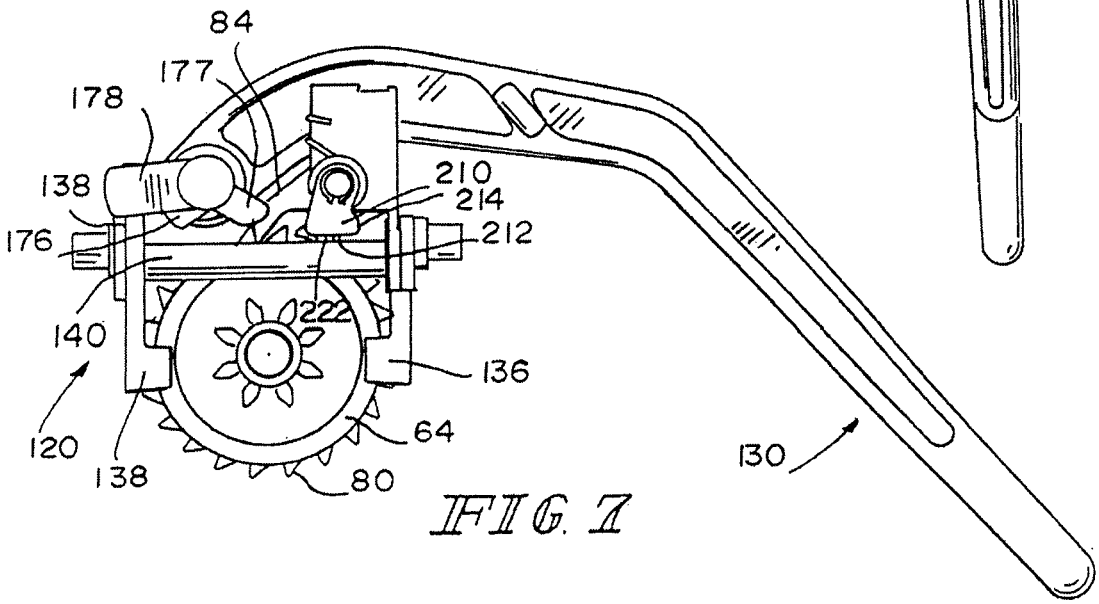
FIG. 7 is a rear view of the handbrake actuator with the quick release handle and the prolong release mechanism in the quick release position.
Figure 8:
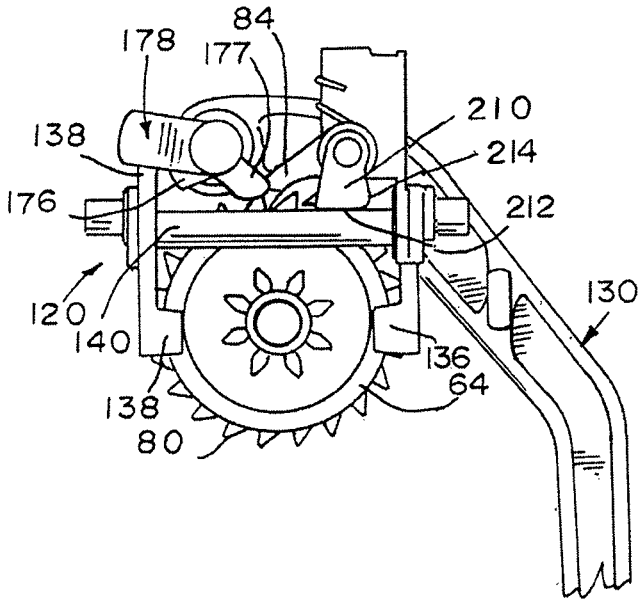
FIG. 8 is a rear view of the handbrake actuator with the quick release handle in the applied position and the prolong release mechanism in the prolonged or sustained release position.

The prolonged release mechanism 200 includes a cam portion 210 and a follower portion 220. The cam 210 includes a camming surface 212 which engages the connecting rod 140 of the de-clutching mechanism 120 in the prolonged release position of FIG. 8. A surface 214 of the cam 210 engages the connecting rod 140 in the apply position of FIG. 6. The cam 210 is shaped to be over center when it engages the connecting rod 140. This causes it to remain engaged with the rod 140 until disengaged by the follower 220. As shown in FIGS. 7 and 8, the length of the cam 210 is shorter than the release position of the de-clutching mechanism 120 adjacent to the cam 210, when the declutching mechanism 120 is in the release position produced by the first cam 178 connected to the quick release handle 130.

Figure 6:
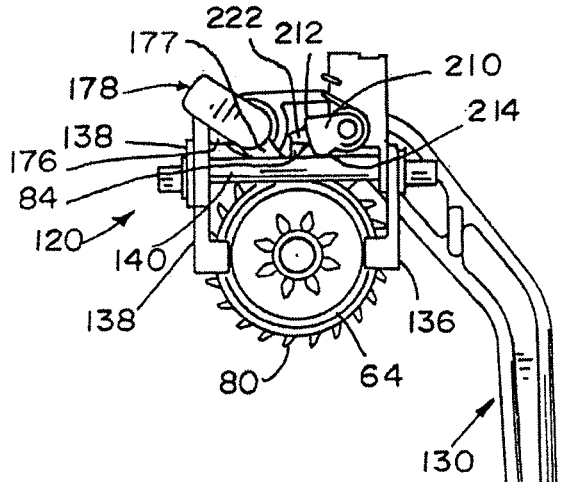
FIG. 6 is a rear view of the handbrake actuator with the quick release handle and the prolong release mechanism in the applied position.

As shown in FIG. 6 the quick release handle 130 is in its apply position. The cam surface 214 engages the bar 140 and cam surface 212 does not. Also, the brake release or hold-down cam 178 does not engage lever 138 of the de-clutching mechanism 120 in this position.

When the quick release handle 130 is raised to its quick release position as illustrated in FIG. 7, cam 178 engages lever 138 of the de-clutching mechanism 210 to move it to the release position, which disengages the clutch elements 104 and 106. At this time, the spring 208 rotates the cam 210 to the position illustrated in FIG. 7 opposite but displaced from the connecting rod 140. As long as the operator holds the handle 130 in the release position the clutch is disengaged.

When the operator releases the handle 130, the cam 178 rotates up off the lever 138 and the rod 140 comes into engagement with cams surface 212 of cam 210. The handle 130 has been rotated from its release position in FIG. 7 to its initial or apply position of FIG. 8, because of the lost motion of elements 168-174. The over-center cam 210 stays in that position until reset.

The applied brake position of FIG. 6 is also illustrated in FIG. 3. The release position of FIG. 7 is illustrated in FIG. 4.

The resetting of the prolonged release cam 210 is produced by the follower 220 sensing rotation of the input or hand wheel 30 in the applied direction. There are at least three specific embodiments of this resetting mechanism illustrated in FIGS. 9 through 11. The follower 220 includes a lower horizontal portion 222 connected to an upper horizontal portion 224 by a vertical portion 226.

Figure 9:
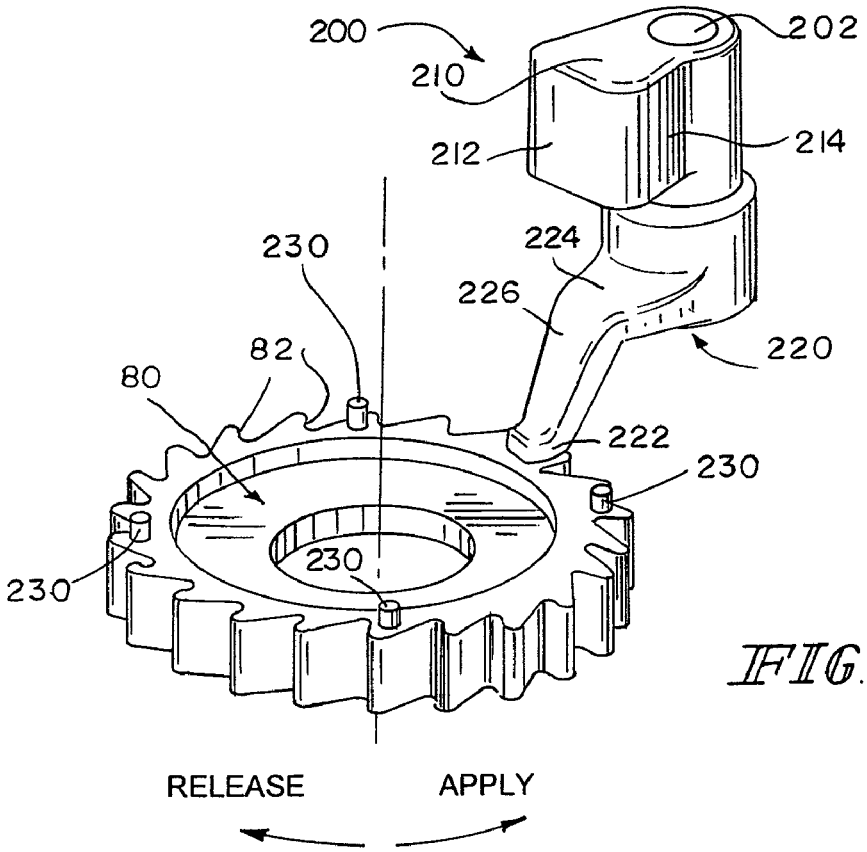
FIG. 9 a perspective view of a first embodiment of a reset mechanism for the prolonged release cam.

In the first embodiment of FIG. 9, at least one pin 230 has been added to the ratchet wheel 80. In the illustrated embodiment there are four pins 230. The prolonged release mechanism 220 is shown in its prolonged release position. The end 222 of the follower 220 is in the path of the pins 230. As the ratchet wheel 80 is rotated in the applied direction, pin 230 will come into contact with the end 222 of the follower 220 and rotates it clockwise against the tension of spring 208. This will cause the cam surface 212 to become disengaged from rod 140 and subsequently causing surface 214 to rest on the rod 140. This allows the declutching mechanism to permit the clutch to re-engage.

Figure 10:
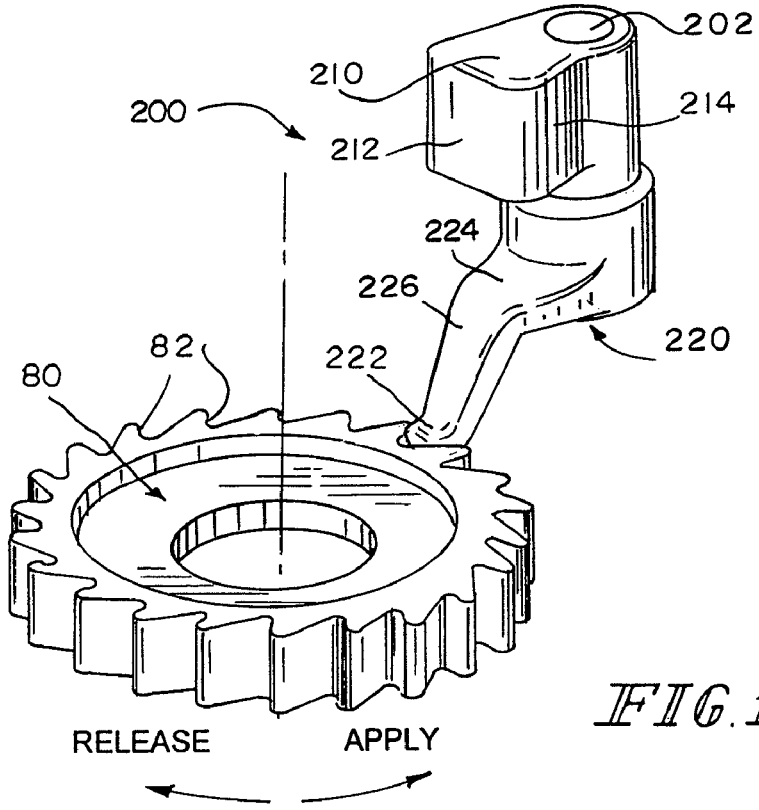
FIG. 10 a perspective view of a second embodiment of a reset mechanism for the prolonged release cam.

The second embodiment of the reset mechanism is illustrated in FIG. 10. The end 222 of the follower 220 is in the path of the teeth 82 of the ratchet wheel 80. The motion of the teeth 82 rotated in the apply direction on the end 222 is sufficient to rotate the camming surface 212 out of engagement with rod 140. Since the end 222 is down at the same plane with the pawl and the ratchet wheel 82, in this embodiment, the second reaction member 177 may be included.

Figure 11:
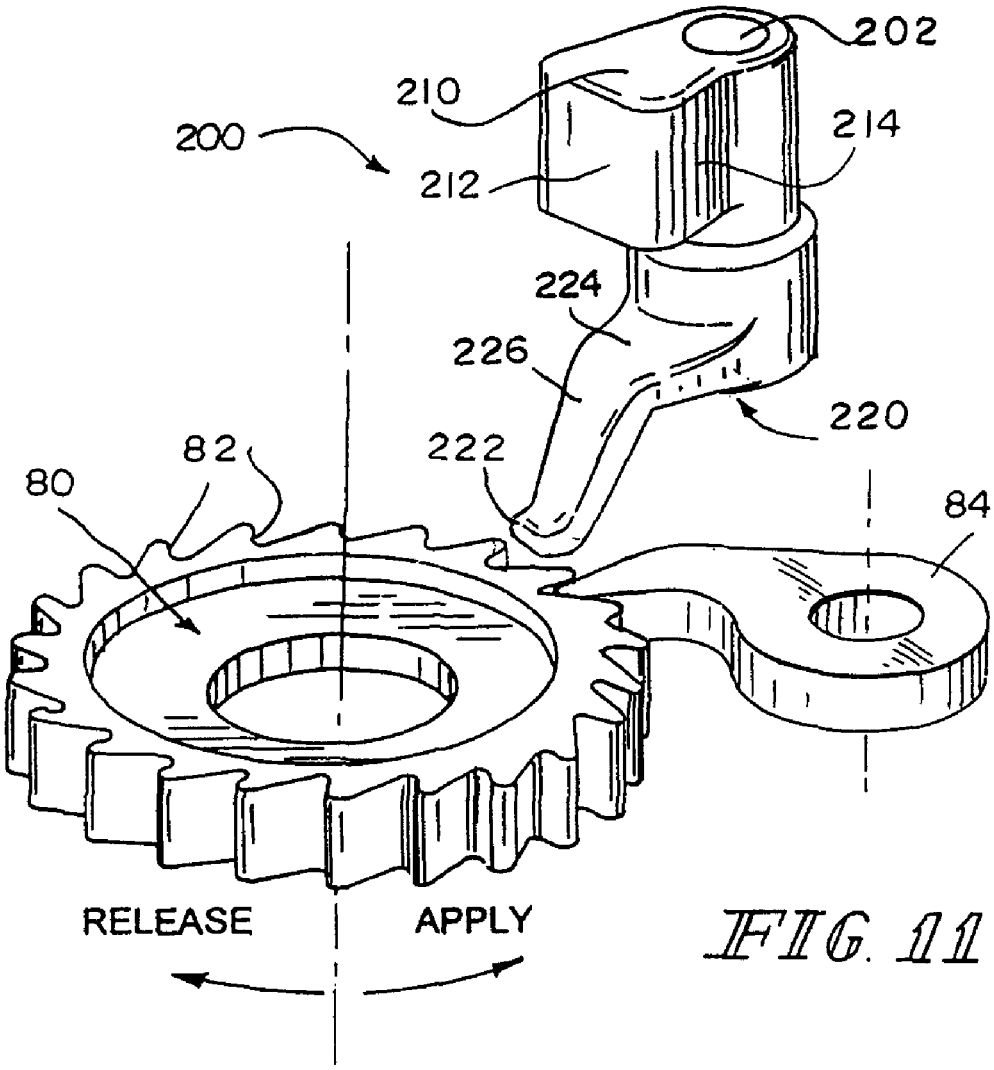
FIG. 11 a perspective view of a third embodiment of a reset mechanism for the prolonged release cam.

In a third embodiment of the reset mechanism illustrated in FIG. 11, the lower end 222 of the follower 220 is adjacent to the pawl 84. As the ratchet wheel 80 is rotated in its applied direction, the paw 84 rotates clockwise engaging end 222 and rotates the cam 212 out of engagement with rod 140. As in the previous embodiment, in that the element 222 of the follower is below the top surface of the ratchet wheel 80, the second reaction member 177 may be included.

The first embodiment of the prolonged release mechanism 200 shows the cam portion 210 and the follower portion 220 as a single unitary structure in FIGS. 5-11. The second embodiment of the prolonged release mechanism 200 shows the cam portion 210 and the follower portion 220 as a two piece structure in FIGS. 12-15.

Figure 12:
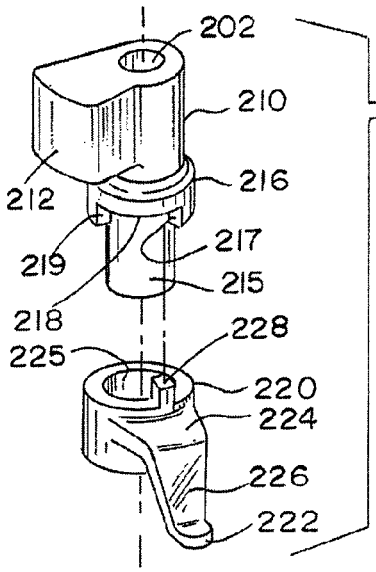
FIG. 12 is an exploded perspective view of a second embodiment of the prolonged release mechanism.

As shown in FIG. 12, the cam 210 includes a shoulder 216 having a recess 218. The end walls of the recess 218 for stops 217 and 219. A shaft 215 of the cam 210 is received in a bore 225 of the follower 220. A tab 228 on the follower rides in the recess 218 between the two stops 217 and 219 as a lost motion mechanism. The spring 208, shown in FIG. 5, biases the cam 210 towards its release position.

Figure 13:
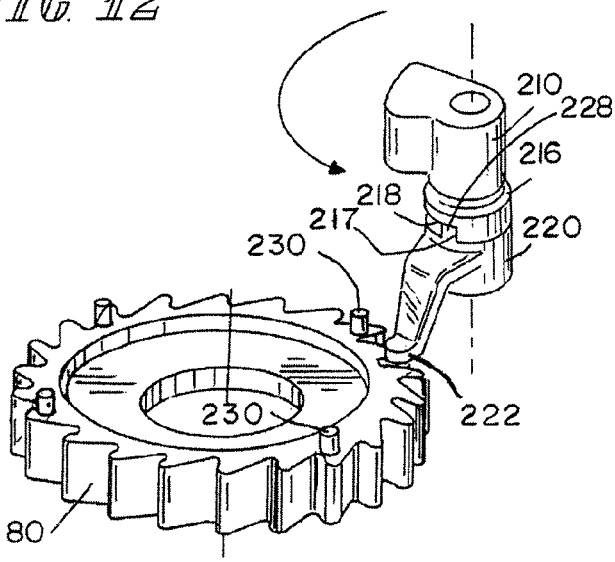
FIG. 13 is a perspective view of the prolonged release mechanism of FIG. 12 with the quick release handle in the applied position.
Figure 14:
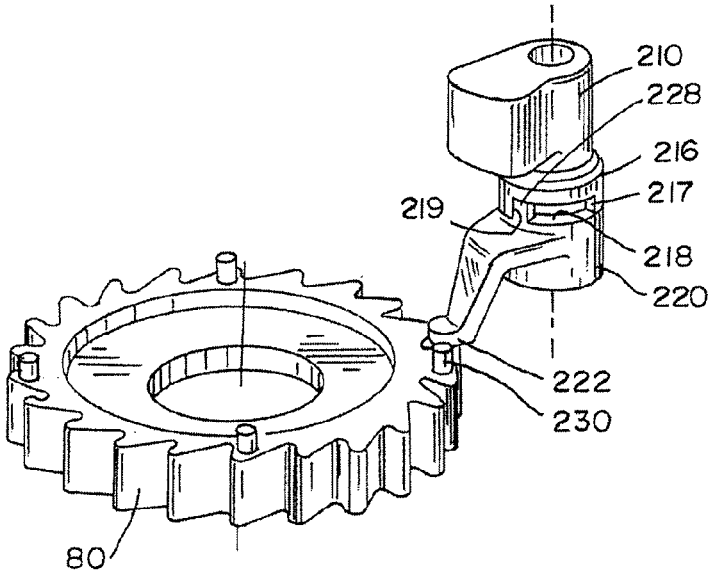
FIG. 14 is a perspective view of the prolonged release mechanism of FIG. 12 with the quick release handle in the quick release position.
Figure 15:
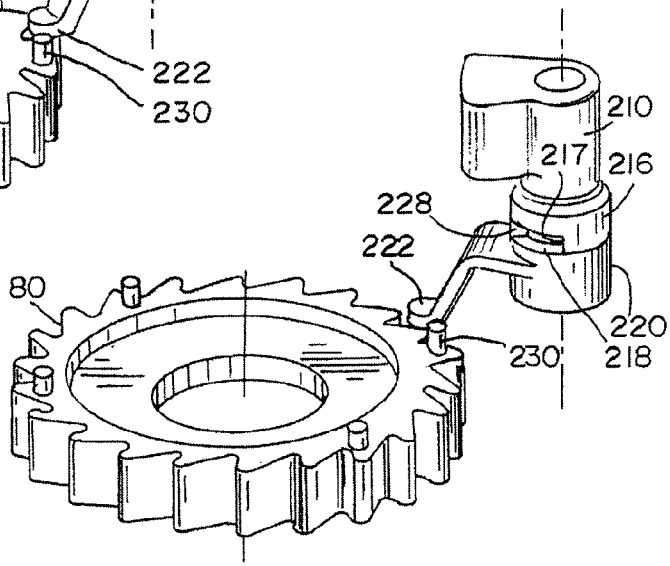
FIG. 15 is a perspective view of the prolonged release mechanism of FIG. 12 after being reset from a quick prolonged release.

In the apply position of FIG. 13, the cam 210 is offset from the follower 220. The cam 210 is restrained by the rod 140, not show, while the follower is free to move relative to the cam 210. In the position shown, gravity, for example, has moved the tab 228 against stop 217. In the release position of FIG. 14, the spring 208 has driven the cam 210 down and in alignment with the follower 220. The tab 228 abuts the stop 218. In the apply position of FIG. 15, the rotation of ratchet wheel 80 causes pin 230 to drive the follower 220 and with it cam 210 to its apply position. After the ratchet wheel 80 stops rotating, the follower may assume the final apply position of FIG. 13.

For more complete operation of the elements with respect to applying and releasing the brake reference should be made to U.S. Pat. No. 4,291,793.

Although the prolonged release mechanism 200 is shown mounted to pin 86, it may be mounted to its own shaft or even the cam shaft 132.

Although the present invention has been described and illustrated in detail, it is to be clearly understood that this is done by way of illustration and example only and is not to be taken by way of limitation. The scope of the present invention is to be limited only by the terms of the appended claims.

What is claimed:

1. A hand brake actuator for a rail car having a rotary input connected to a rotary output by a transmission including a clutch and a ratchet wheel and pawl, a declutching mechanism for disengaging the clutch in a declutched position of the declutching mechanism, and a release handle with a first cam which drives the declutching mechanism to the declutched position when the release handle is moved from an apply position to a release position, the actuator further comprising:

a second cam biased in a first direction to engage and retain the declutching mechanism in a declutched position after the release handle is removed from the release position;

a follower connected to the second cam and responsive to the rotation of the input in an apply direction to rotate the second cam in a second direction opposite the first direction to release the declutching mechanism and allow the clutch to reengage; and including at least one pin mounted on the ratchet wheel and the follower engages and is deflected by the pin when the input is rotated in the apply direction.

2. The hand brake actuator according to claim 1, including a plurality of pins mounted and spaced circumferentially on the ratchet wheel.

3. The hand brake actuator according to claim 1, wherein the follower engages and is deflected by teeth of the ratchet wheel when the input is rotated in the apply direction.

4. The hand brake actuator according to claim 1, wherein the follower engages and is deflected by the pawl when the input is rotated in the apply direction.

5. The hand brake actuator according to claim 1, wherein the second cam, the follower and the pawl are mounted on a common post.

6. The hand brake actuator according to claim 5, including a bracket between the pawl and the follower, and the bracket is a stop for the follower in the first direction of the second cam and follower.

7. The hand brake actuator according to claim 1, wherein the second cam is shaped to be over center when it engages the declutching mechanism.

8. The hand brake actuator according to claim 1, wherein the second cam has a length shorter than the release position of the declutching mechanism adjacent the second cam and produced by the first cam.

9. The hand brake actuator according to claim 1, wherein the second cam and the follower are unitary.

10. The hand brake actuator according to claim 1, wherein the second cam and the follower are two elements connected by a lost motion mechanism.

* * * * *